United States Patent [19]

DiBello

[11] Patent Number: 5,063,111

[45] Date of Patent: Nov. 5, 1991

[54] DEGRADABLE BOTTLE AND CAN CARRIER COATED WITH ULTRAVIOLET ABSORBER

[75] Inventor: Louis M. DiBello, Perrysburg, Ohio

[73] Assignee: Owens-Illinois Plastic Products Inc., Toledo, Ohio

[21] Appl. No.: 474,883

[22] Filed: Feb. 5, 1990

[51] Int. Cl.[5] ..... B65D 71/00; B32B 27/00

[52] U.S. Cl. ..... 428/411.1; 428/137; 428/500; 428/523; 428/178; 428/913; 206/139; 220/DIG. 30

[58] Field of Search ..... 428/137, 500, 523, 411.1, 428/913; 206/139; 220/DIG. 30; 426/178

[56] References Cited

U.S. PATENT DOCUMENTS

| | | | |
|---|---|---|---|
| 3,705,659 | 12/1972 | Mackie | 220/DIG. 30 X |
| 3,795,654 | 3/1974 | Kirkpatrick | 220/DIG. 30 X |
| 4,169,902 | 10/1979 | Delong | 428/907 X |
| 4,193,989 | 3/1980 | Teng et al. | 424/64 X |
| 4,576,870 | 3/1986 | Liebler et al. | 428/515 |
| 4,708,908 | 11/1987 | Tateoka et al. | 428/524 X |
| 4,709,808 | 12/1987 | Balduff et al. | 220/DIG. 30 X |

*Primary Examiner*—Ellis P. Robinson
*Assistant Examiner*—William P. Watkins, III

[57] ABSTRACT

A degradable bottle and can carrier comprising a body having a plurality of openings for receiving the bottles or cans. The body is made of a plastic material which is degradable upon exposure to ultraviolet radiation. A water soluble ultraviolet absorber is applied to the exposed surface of the carrier such that the carrier is protected from degrading under ultraviolet radiation until such time that the carrier is discarded and becomes wet by rainfall, water or snow.

4 Claims, 1 Drawing Sheet

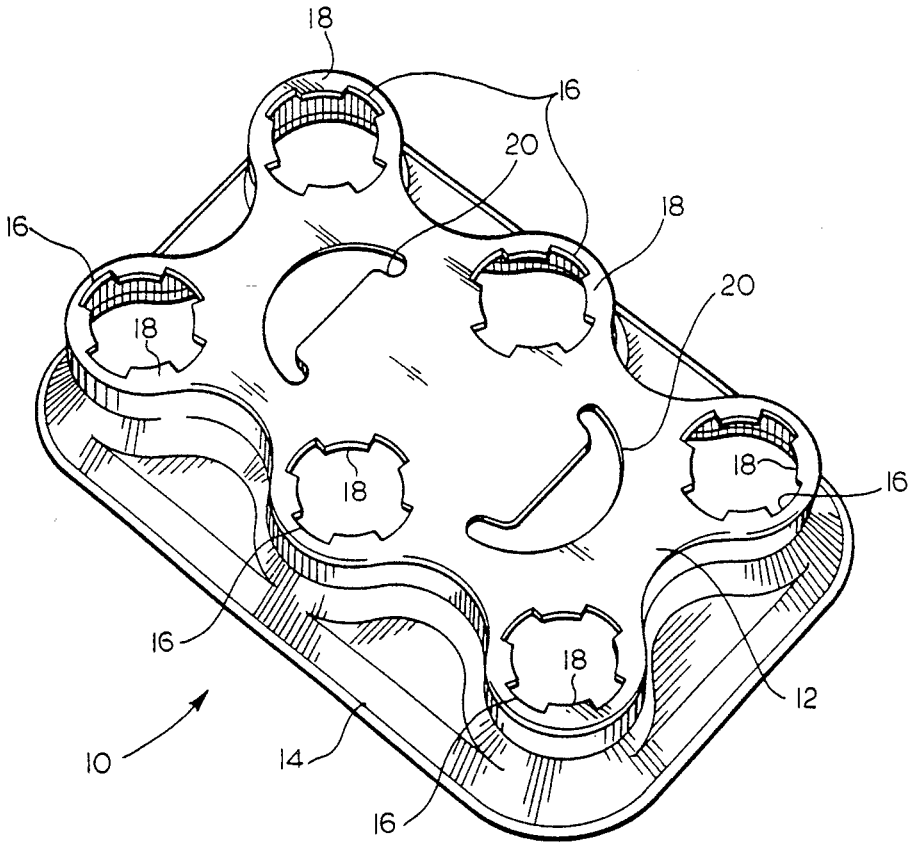
FIG. 1
*PRIOR ART*
FIG. 2
*PRIOR ART*
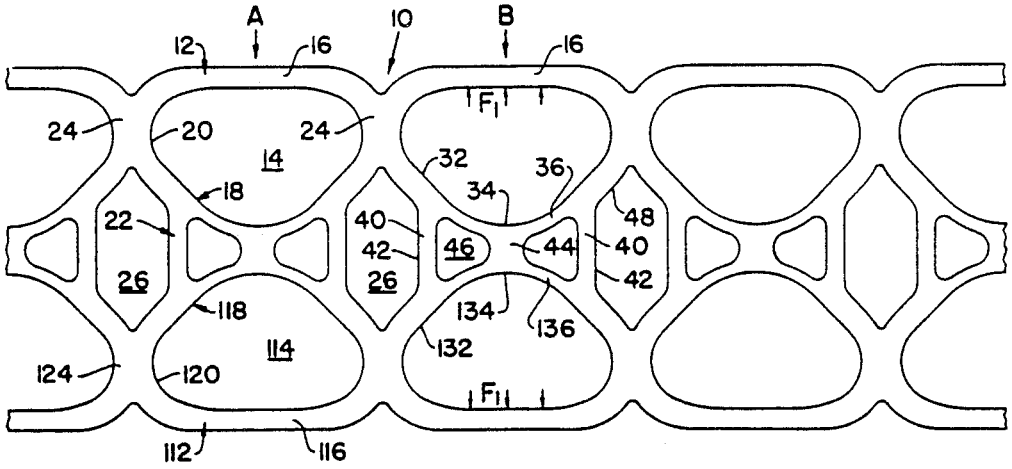

DEGRADABLE BOTTLE AND CAN CARRIER COATED WITH ULTRAVIOLET ABSORBER

This invention relates to carriers for bottles and cans and particularly to degradable carriers for bottles and cans.

BACKGROUND AND SUMMARY OF THE INVENTION

It is common to provide carriers for bottles and cans which are made of plastic material. For environmental purposes, the carrier may be made of a degradable plastic. One type of degradable plastic degrades under ultraviolet radiation such as sunlight or fluorescent lighting. If such a carrier is placed on a shelf and exposed to such radiation for a time, the carrier will lose strength and it is possible that the bottles or cans will fall out when the carrier is lifted.

Among the objectives of the present invention are to provide a degradable carrier which will not degrade in normal use and will only degrade when it becomes wet due to rainfall, water or snow; which carrier can be made at relatively low cost; and which effectively holds the bottles or cans during normal usage.

In accordance with the invention, a degradable bottle and degradable can carrier comprises a body having a plurality of openings for receiving the bottles or cans. The body is made of a plastic material which is degradable upon exposure to ultraviolet radiation. A water soluble ultraviolet absorber is applied to the exposed surface of the carrier such that the carrier is protected from degrading under ultraviolet radiation until such time that the carrier is discarded and becomes wet by rainfall, water or snow.

DESCRIPTION OF THE DRAWINGS

FIG. 1 is a perspective view of a known bottle carrier.

FIG. 2 is a plan view of a known can carrier.

DESCRIPTION

In accordance with the invention, a degradable bottle or can carrier comprises a body having a plurality of openings for receiving the bottles or cans. The body is made of a plastic material which is degradable upon exposure to ultraviolet radiation. A water soluble ultraviolet absorber is applied to the exposed surface of the carrier such that the carrier is protected from degrading under ultraviolet radiation until such time that the carrier is discarded and becomes wet by rainfall, water or snow.

FIG. 1 shows the manner in which the invention is applicable to a bottle carrier. In a first embodiment of the invention, a degradable polymeric composition comprising an admixture of high density polyethylene and ethylene-carbon monoxide copolymer of up to 9.99 percent by weight ethylene-carbon monoxide copolymer and the remainder of high density polyethylene has been discovered to have surprisingly good properties for use as a rigid article carrier. As illustrated in FIG. 1, such a rigid article carrier is suited to carry a plurality of narrow neck containers, like bottles for beer and soft drinks of the type shown in U.S. Pat. No. 4,139,094, incorporated herein by reference. The carrier comprises a rigid carrier member 10 which includes a generally planar top panel 12 and a downwardly depending sidewall portion 14. The top panel 12 includes a plurality of generally circular container supporting apertures 16 which each include a plurality of inwardly extending rigid tab members 18 which engage a bottle neck below the threaded portion of the finish of a container, particularly a narrow neck bottle. Typically such rigid carrier members 10 include a pair of hand grips 20 for easy carrying of the rigid carrier member 10 when fully loaded with bottles.

A layer of ultraviolet absorber is applied to the outer surface in a continuous layer as by spraying, dipping, printing, for example flexograph or off-set, and permitted to dry producing a layer L on the surface.

The invention can also be applied to can carriers such as are well known in the art as shown, for example, in U.S. Pat. No. 4,219,117, incorporated herein by reference, wherein a number of carriers are interconnected in a strip stock 10 to define a series of bands 12 that are configured to produce a series of apertures 114, which are of a circumferential dimension less than the dimension of the container surface to be encircled. A general description of the elements of the invention will be best understood by referring to the laterally aligned pair of bands A in FIG. 1. The bands 112 incorporate a generally straight outer band section 116 and a substantially V-shaped or yoke-shaped inner band section 118. The V-shaped inner band section 118 is integrally connected to its associated substantially straight outer band section 16, 116 by a radiused corner region 120. The apices of bands 112 are integrally connected to one another by a first web means 122. The longitudinally adjacent bands 112 on either side of the first web 122 are integrally connected by second web means 124. The longitudinal extremities of each first web means 122 and selected outer margins of the inner sections 118 and second web means 124 create an aperture 126 which can serve as a finger hole to facilitate carrying the package formed by the carrier device and the container.

Any water soluble ultraviolet absorber can be used such as, for example, p-aminobenzoic acid, 3,5-ditertiary-butyl p-hydroxy-benzoic acid, ethylhexyl-p-methoxycinnamate, phenyl salicylate, and t-butylphenyl salicylate. Preferably the absorber is provided in an alcohol solution so that it can be applied by dipping or spraying and the alcohol will readily evaporate leaving a layer of absorber over the exposed surfaces of the carrier.

In either form, when the carrier becomes wet due to rainfall, water or snow, the absorber is washed away so that when the carrier exposed to sunlight or fluorescent lighting it will be degraded.

It can thus be seen that there has been provided a degradable carrier which will not degrade in normal use and will only degrade when it becomes wet due to rainfall, water or snow; which carrier can be made at relatively low cost; and which effectively holds the bottles or cans during normal usage.

Although the invention is particularly useful in bottle and can carriers, it is also applicable to other types of carriers such as plastic trash or mulch bags made of a degradable plastic material.

I claim:

1. A degradable carrier comprising:

a body, said body being made of a degradable polymeric composition comprising a polymer and a degradable additive such that the carrier is degradable upon exposure to ultraviolet radiation, said body having an exposed surface, a water soluble coating containing an ultraviolet absorber applied in a layer to said exposed surface of the carrier to define a water soluble coating covering said exposed surface such that the coating protects the carrier from degrading under ultraviolet radiation until such time that the carrier is discarded and becomes wet by rainfall, water or snow, whereupon the coating washes away so that the carrier will thereafter be readily degraded by sunlight or fluorescent lighting.

2. The carrier set forth in claim 1 wherein said carrier is a carrier for bottles.

3. The carrier set forth in claim 1 wherein said carrier is a carrier for cans.

4. The carrier set forth in claim 1 wherein said exposed coating comprises substantially only said ultraviolet absorber.

* * * * *